US008926338B2

(12) United States Patent
Kiryu et al.

(10) Patent No.: US 8,926,338 B2
(45) Date of Patent: Jan. 6, 2015

(54) CONTACT MEMBER

(71) Applicant: Fujitsu Component Limited, Tokyo (JP)

(72) Inventors: Koichi Kiryu, Nagano (JP); Manabu Shimizu, Tokyo (JP)

(73) Assignee: Fujitsu Component Limited, Tokyo (JP)

( * ) Notice: Subject to any disclaimer, the term of this patent is extended or adjusted under 35 U.S.C. 154(b) by 8 days.

(21) Appl. No.: 14/025,996

(22) Filed: Sep. 13, 2013

(65) Prior Publication Data

US 2014/0087605 A1 Mar. 27, 2014

(30) Foreign Application Priority Data

Sep. 27, 2012 (JP) ..... 2012-215290

(51) Int. Cl.

| | |
|---|---|
| ***H01R 12/00*** | (2006.01) |
| ***H01R 13/24*** | (2006.01) |
| *H01R 12/57* | (2011.01) |
| *H01R 12/71* | (2011.01) |
| *H01R 12/73* | (2011.01) |
| *H01R 101/00* | (2006.01) |

(52) U.S. Cl.

CPC ..... *H01R 13/24* (2013.01); *H01R 13/2442* (2013.01); *H01R 12/57* (2013.01); *H01R 12/718* (2013.01); *H01R 12/73* (2013.01); *H01R 2101/00* (2013.01)

USPC ..... 439/66; 439/884

(58) Field of Classification Search

USPC ..... 439/65–74, 862, 884

See application file for complete search history.

(56) References Cited

U.S. PATENT DOCUMENTS

| | | | | |
|---|---|---|---|---|
| 8,708,711 | B2 * | 4/2014 | Horikawa | 439/66 |
| 8,784,118 | B2 * | 7/2014 | Ihara | 439/66 |
| 8,827,730 | B2 * | 9/2014 | Ihara | 439/206 |
| 8,834,183 | B2 * | 9/2014 | Komoto et al. | 439/74 |

FOREIGN PATENT DOCUMENTS

| | | |
|---|---|---|
| JP | 2009-272237 | 11/2009 |

* cited by examiner

*Primary Examiner* — Khiem Nguyen
(74) *Attorney, Agent, or Firm* — IPUSA, PLLC

(57) ABSTRACT

A contact member includes first and second bent portions provided between a joining part to be joined to a first board and a contacting part to come into contact with a second board, a first contact part to come into contact with the second bent portion when the first bent portion is caused to bend by the pressing of the contacting part by the second board, a second contact part to come into contact with the first bent portion when the second bent portion is caused to bend by the pressing of the contacting part by the second board after the first contact part comes into contact with the second bent portion, and a third contact part to come into contact with the first board by the pressing of the contacting part by the second board after the second contact part comes into contact with the first bent portion.

6 Claims, 7 Drawing Sheets

CONTACT MEMBER

CROSS-REFERENCE TO RELATED APPLICATION

The present application is based upon and claims the benefit of priority of Japanese Patent Application No. 2012-215290, filed on Sep. 27, 2012, the entire contents of which are incorporated herein by reference.

BACKGROUND OF THE INVENTION

1. Field of the Invention

The present invention relates to contact members.

2. Description of the Related Art

Electronic apparatuses such as cellular phones and smartphones have been reduced in size and thickness, and in response to this, the form of mounting parts on a printed circuit board (hereinafter abbreviated to "board") provided inside apparatuses has mostly shifted to the surface mounting of chip parts.

In these electronic apparatuses, a ground (GND) line of the board is connected to a conductor panel of the enclosure (so-called frame grounding [FG]) in order to protect electronic parts mounted on the board and to deal with noise. Frame grounding is also performed between boards. In this case, a surface-mount contact member is used to connect respective conductors of the boards.

The contact member used in FG is a member having a spring characteristic, which is formed by bending a leaf spring to have a predetermined amount of stroke. The contact member is joined to a conductor of one of the boards and is compressed by being pressed by the other of the boards to electrically connect the conductors of the boards. In order to establish a stable electrical connection, the contact member for such use is desired to have a spring stroke amount corresponding to the pressing stroke of a board and to have a contact pressure of contact with the board over a wide area in response to pressing by the board.

Furthermore, usually, an automatic mounting apparatus is used to mount electronic parts on the surface of a board. In the case of a large electronic part, the automatic mounting apparatus holds the electronic part by clamping the electronic part with claws, and mounts the electronic part at a predetermined position. On the other hand, in the case of a small electronic part, the electronic part is held by attraction and adhesion using a suction nozzle. Accordingly, such a small electronic part subjected to mounting by the automatic mounting apparatus has an attracted part that is attracted and adhered to the suction nozzle.

Such conventional contact members used for surface mounting include the following.

For example, Japanese Laid-Open Patent Application No. 2009-272237 discloses a surface-mount contact that obtains three levels of contact pressure because of two folded parts and a deformation restricting part and has an attracted surface that is attracted and adhered to a suction nozzle.

SUMMARY OF THE INVENTION

According to an aspect of the present invention, a contact member that electrically connects a first board and a second board includes a joining part configured to be joined to the first board, a contacting part configured to come into contact with the second board, a first bent portion and a second bent portion provided between the joining part and the contacting part, a first contact part configured to come into contact with the second bent portion when the first bent portion is caused to bend by pressing of the contacting part by the second board, a second contact part configured to come into contact with the first bent portion when the second bent portion is caused to bend by the pressing of the contacting part by the second board after the first contact part comes into contact with the second bent portion, and a third contact part configured to come into contact with the first board by the pressing of the contacting part by the second board after the second contact part comes into contact with the first bent portion.

DESCRIPTION OF THE EMBODIMENTS

Embodiments of the present invention are described below with reference to the accompanying drawings.

Figure 1A:
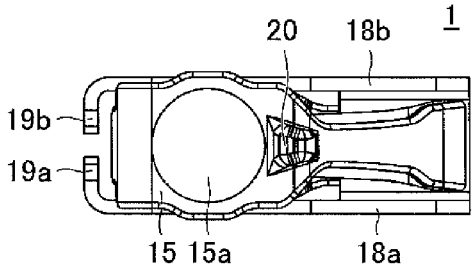
FIGS. 1A, 1B, 1C, 1D, 1E, and 1F are a plan view, a left side view, a front view, a right side view, a bottom view, and a perspective view, respectively, of a contact member according to an embodiment.
Figure 1B:
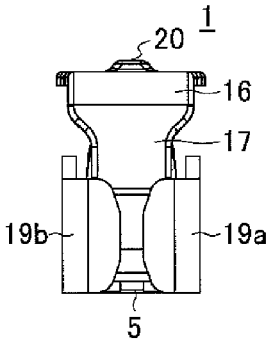
Figure 1C:
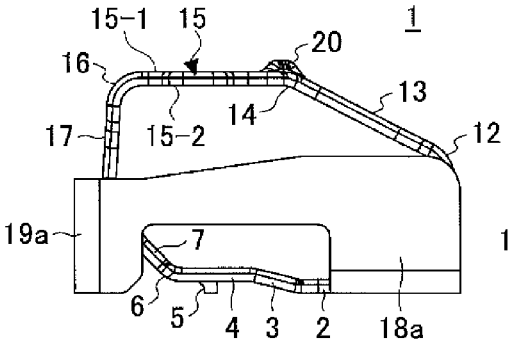
Figure 1D:
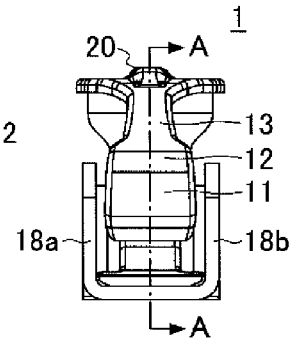
Figure 1E:
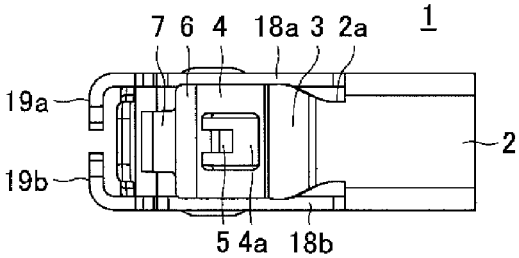
Figure 1F:
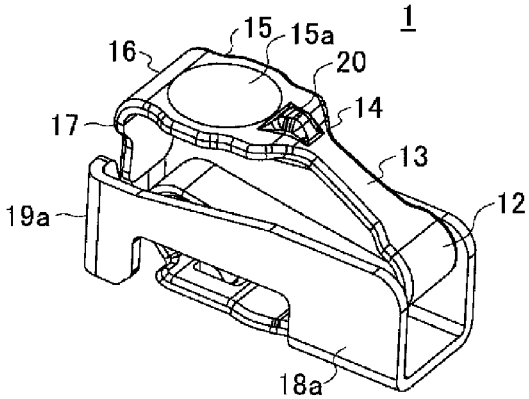
Figure 2:
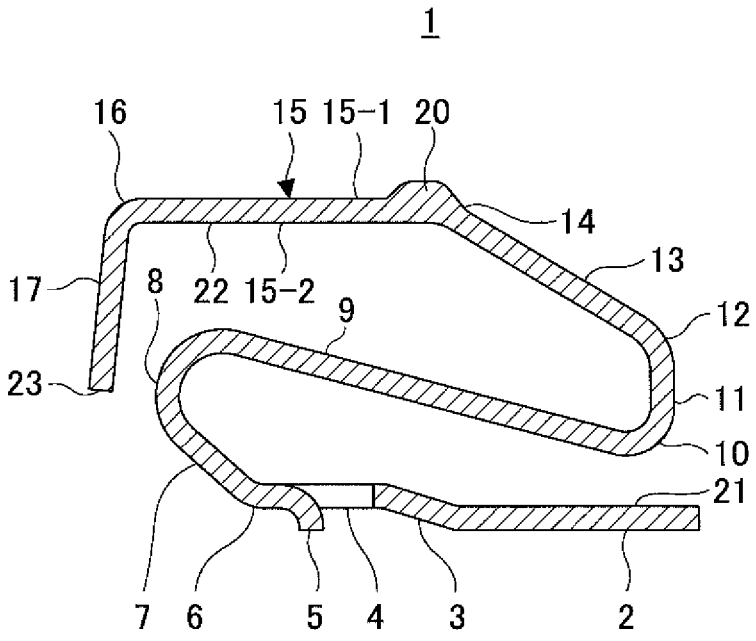
FIG. 2 is a cross-sectional view of the contact member, taken along a plane including line A-A in FIG. 1D.

FIGS. 1A through 1F and FIG. 2 are diagrams illustrating an embodiment of a contact member. FIGS. 1A, 1B, 10, 1D, 1E and 1F are a plan view, a left side view, a front view, a right side view, a bottom view, and a perspective view, respectively, of a contact member 1 according to an embodiment. FIG. 2 is a cross-sectional view of the contact member 1, taken along a plane including line A-A in FIG. 1D.

The contact member 1 according to this embodiment has a spring characteristic and electrically connects respective contacts of two boards.

As a material for the contact member 1, an electrically-conductive metal plate that has a spring characteristic is used. Examples of such metal plates include those of phosphor bronze, beryllium copper, and stainless steel. The contact member 1 is formed by processing a single metal plate of, for example, 0.08 mm to 0.15 mm in thickness (hereinafter referred to as "leaf spring") into the shape illustrated in the drawings by press working. Furthermore, the contact member 1 may be partly or entirely plated with nickel, copper, or gold as desired.

Referring to FIGS. 1A through 1F and FIG. 2, the contact member 1 includes a horizontal part 15. The horizontal part includes first and second opposite surfaces 15-1 and 15-2, which face upward and downward, respectively, in FIG. 1C and FIG. 2. Furthermore, in order to describe the directions of bending of a leaf spring by press working, a direction in which a surface of the leaf spring on the same side as the first surface 15-1 of the horizontal part 15 is bent inward (folded in "valley fold") is referred to as "first bending direction" and a direction in which a surface of the leaf spring on the same side as the first surface 15-1 of the horizontal part 15 is bent outward (folded in "mountain fold") is referred to as "second bending direction."

The contact member 1 includes a first joining part 2 to be joined to a board surface by, for example, soldering, a rising part 3 that is bent in the first bending direction from the first joining part 2 to rise from the board surface, an intermediate part 4 that is continuous with the rising part 3, bent in the second bending direction, and spaced apart from the board surface, and a second joining part 5 that extends from an opening part 4*a* formed in the intermediate part 4 to come into contact with the board surface.

Referring to FIG. 1E, the first joining part 2 includes a tapered part 2*a* that is continuous with the rising part 3. The tapered part 2*a* is provided so that the width (a vertical dimension in FIG. 1E) of the first joining part 2 gradually increases to match the width of the rising part 3.

Referring to FIG. 1E, the intermediate part 4 is pierced to have an opening of an angular letter C shape by pressing, and the opening becomes the opening part 4*a* and a portion left surrounded by the opening becomes the second joining part 5. Furthermore, as illustrated in FIG. 10, the second joining part 5 is so bent as to extend downward from a surface of the intermediate part 4. The length of the second joining part 5 may be such that the second joining part 5 either comes into contact with the board surface or is slightly above the board surface when the contact member 1 is provided on the board with the first joining part 2 joined to the board surface.

The contact member 1 further includes a first bent part 6 that is bent obliquely upward in the first bending direction from the intermediate part 4 in FIG. 1C, a first spring part 7 that is continuous with the first bent part 6, a second bent part 8 that is continuous with the first spring part 7 and is bent in the first bending direction, and a second spring part 9 that is continuous with the second bent part 8.

The first bent part 6, the first spring part 7, the second bent part 8, and the second spring part 9 form a "first bent portion" of the contact member 1. The first bent portion has a first spring constant. The first spring constant may be determined by the shape of the first bent portion.

The contact member 1 further includes a third bent part 10 that is continuous with the second spring part 9 and is bent in the second bending direction, a third spring part 11 that is continuous with the third bent part 10, a fourth bent part 12 that is continuous with the third spring part 11 and is bent in the second bending direction, a fourth spring part 13 that is continuous with the fourth bent part 12, and a fifth bent part 14 that is continuous with the fourth spring part 13 and is bent in the second bending direction.

The third bent part 10, the third spring part 11, the fourth bent part 12, and the fourth spring part 13 form a "second bent portion" of the contact member 1. The second bent portion has a second spring constant. The second spring constant may be determined by the shape of the second bent portion.

The contact member 1 includes the horizontal part 15, which is continuous with the fifth bent part 14. The first surface 15-1 of the horizontal part 15 includes an attracted part 15*a*, which is a surface that is attracted and adhered to a suction nozzle of an automatic mounting apparatus by its pickup operation. The horizontal part 15 is substantially parallel to the first joining part 2, so that the horizontal part 15 may have the attracted part 15*a* attracted and adhered by an automatic mounting apparatus when the first joining part 2 is placed on a horizontal plane.

The contact member 1 further includes a contacting part 20 that comes into contact with a second board 200 illustrated in FIGS. 3A through 3E. As illustrated in FIG. 1A, the horizontal part 15 extends in a direction away from the second bent portion relative to the contacting part 20. That is, the contacting part 20 is positioned at the right end of the horizontal part 15 in FIG. 1A, so that a large area may be ensured for the attracted part 15*a* on the first surface 15-1 of the horizontal part 15. Furthermore, because the contacting part 20 is narrower in width (a vertical dimension in FIG. 1A) than the horizontal part 15, it is possible to increase the contact pressure of contact with the second board 200. In addition, as illustrated in FIG. 1C, the contacting part 20 has a shape projecting upward from the horizontal part 15. Therefore, when the contact member 1 is pressed from above in FIG. 1C by the second board 200, the contacting part 20 comes into contact with the second board 200.

Referring to FIG. 2, the contact member 1 further includes a first contact part 21 and a second contact part 22. The first contact part 21 is an upper surface of the first joining part 2 that is approached and contacted by the vicinity of the third bent part 10, which is part of the second bent portion, as a result of the bending of the first bent portion. Because the contact position of the second bent portion on the first joining part 2 moves because of the bending of the first bent portion even after the second bent portion comes into contact with the first joining part 2, the first contact part 21 comes into contact with the second bent portion not at a point but over a certain area on the first joining part 2.

The second contact part 22 is part of the second surface 15-2 of the horizontal part 15, which approaches and comes into contact with the vicinity of the second bent part B, which is part of the first bent portion, as a result of further bending of the second bent portion after the first contact part 21 comes into contact with the second bent portion. Because the contact position of the first bent portion on the second surface 15-2 of the horizontal part 15 moves because of the bending of the second bent portion even after the first bent portion comes into contact with the second surface 15-2 of the horizontal part 15, the second contact part 22 comes into contact with the first bent portion not at a point but over a certain area on the second surface 15-2 of the horizontal part 15.

The contact member 1 further includes a sixth bent part 16 that is continuous with the horizontal part 15 and is bent in the second bending direction and a stopper part 17 that is continuous with the sixth bent part 16 and extends downward in FIG. 2. The stopper part 17 includes a third contact part 23 at its end. When the first bent portion and the second bent portion bend so that the stopper part 17 lowers, the third contact part 23 comes into contact with a first board 100 illustrated in FIGS. 3A through 3E. The stopper part 17 restricts the bending of the first bent portion and the second bent portion so as to prevent a stress applied from the second board 200 to the contact member 1 from being applied to the first bent portion and the second bent portion beyond their elastic limits. As a result, it is possible to prevent the contact member 1 from being damaged or plastically deformed.

Referring to FIGS. 1A through 1F, the contact member 1 further includes protection parts 18*a* and 18*b* that are bent from the first joining part 2 to rise from a surface of the first joining part 2. The protection parts 18*a* and 18*b* serve as a guide for proper bending of the first bent portion of the contact member 1, and may also be used as a holding position in a clamping device of an automatic mounting apparatus.

The contact member 1 further includes guide parts 19*a* and 19*b*, which are so arranged as to enclose the stopper part 17. As illustrated in FIGS. 1A and 1B, the guide parts 19*a* and 19*b* are formed by bending the protection parts 18*a* and 18*b*, respectively, so as to cover the left side of the stopper part 17 as illustrated in FIGS. 1A through 10.

As described above, according to this embodiment, bent parts and spring parts are integrally formed. The bent parts and spring parts of the first bent portion and the second bent portion, however, are not limited to the above-described configuration. For example, the first bent part 6, the first spring part 7, the second bent part 8, and the second spring part 9 may be formed as a single bent part having the first spring constant. Likewise, the second bent portion as well is not limited to the shape illustrated in this embodiment. The shapes of the bent portions in this embodiment are examples of shapes as a contact member according to this embodiment.

Next, a displacement of the contact member 1 according to this embodiment is described with reference to FIGS. 3A, 3B, 3C, 3D and 3E and FIG. 4. FIGS. 3A through 3E are diagrams sequentially illustrating, from FIG. 3A to FIG. 3E, a displacement of the contact member 1, joined to the first board 100 by surface mounting, at the time of pressing on the contact member 1 with the second board 200. In FIGS. 3A through 3E, the first board 100 has an electrically conductive part (not illustrated) on its upper surface. The contact member 1 is mounted on the upper surface of the first board 100 with the first joining part 2 being joined to the electrically conductive part on the upper surface by soldering or the like. The contacting part 20 of the contact member 1 comes into contact with an electrically conductive part (not illustrated) provided on a lower surface of the second board 200. As a result, frame grounding (FG) is established between the first board 100 and the second board 200.

Figure 3A:
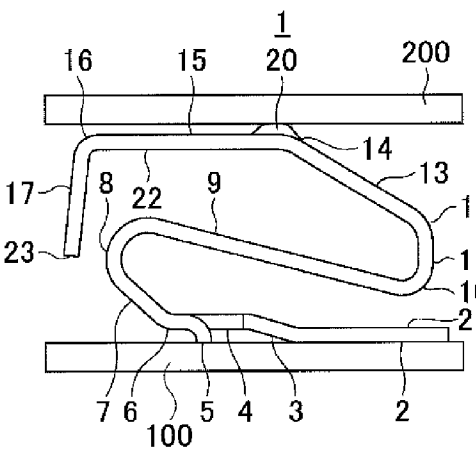
FIGS. 3A, 3B, 3C, 3D, and 3E are diagrams illustrating a displacement of a contact member according to the embodiment.

FIG. 3A illustrates a state where the second board 200 has first come into contact with the contact member 1. In FIG. 3A, the contact member 1 has not received a downward force from the second board 200, and the contact member 1 is not displaced. Accordingly, the horizontal part 15 is substantially horizontal. A dotted line in FIGS. 3B through 3E indicates the position of the contact member 1 in FIG. 3A.

Figure 3B:
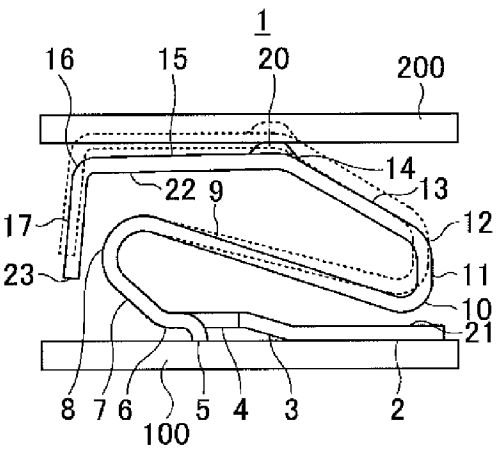

FIG. 3B illustrates a state at a time when the second board 200 is depressed. In this embodiment, the first spring constant is determined to be smaller than the second spring constant. Therefore, when a downward force is applied to the horizontal part 15 by the second board 200, the first bent portion having a smaller spring constant bends more than the second bent portion having a larger spring constant.

The effect of the bending of the first bent portion and the bending of the second bent portion on the inclination of the horizontal part 15 is described. When the first bent portion bends, the surface of the horizontal part 15 rotates (moves) clockwise. On the other hand, when the second bent portion bends, the surface of the horizontal part 15 rotates (moves) counterclockwise. Accordingly, when both the first bent portion and the second bent portion bend, the rotation directions of the horizontal part 15 cancel out. Therefore, even when the entire contact member 1 is compressed by the pressure of the second board 200, the surface of the horizontal part 15 is likely to be kept in a horizontal position. That is, this movement may be obtained by providing the horizontal part 15 ahead of the first bent portion and the second bent portion. The contact member 1 moves in the same manner when a suction nozzle of an automatic mounting apparatus depresses the attracted part 15*a*. That is, even when the suction nozzle is pressed against the attracted part 15*a*, the attracted part 15*a* is less likely to be inclined, so that it is possible to reduce attraction errors.

The first spring constant and the second spring constant may be suitably determined in accordance with mechanical characteristics desired of the contact member 1. For example, when the first spring constant is determined to be an even smaller value than the second spring constant, it is possible to cause the second bent portion to hardly bend before the first bent portion bends to have the first contact part 21 coming into contact with the second bent portion. On the other hand, when the first spring constant and the second spring constant are closer, the second bent portion also considerably bends in accordance with the second spring constant before the first contact part 21 stops the second bent portion.

The horizontal part 15 is so positioned as to have no effect on the respective spring constants of the first bent portion and the second bent portion. Therefore, in designing the respective shapes of the first bent portion and the second bent portion, the shape of the horizontal part 15 may not be taken into consideration in determining the spring performance.

Figure 3C:
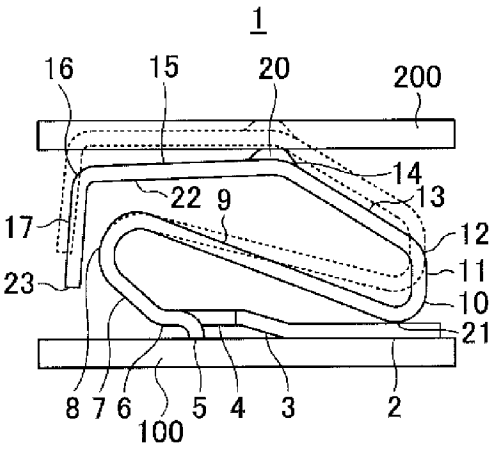

FIG. 3C illustrates a state where the first contact part 21 comes into contact with the vicinity of the third bent part 10 to restrict the bending of the first bent portion. The first bent portion bends with the first spring constant, so that the first contact part 21 comes into contact with the vicinity of the third bent part 10 of the second bent portion. The bending of the first bent portion is restricted by the contact of the first contact part 21 and the second bent portion. This state is referred to as "first restricted state." The contact of the first contact part 21 with the second bent portion shortens the electrical distance of a conductor, so that it is possible to reduce the overall impedance of the contact member 1. This reduction in impedance is particularly effective in the frame grounding of boards that use high frequencies.

Figure 3E:
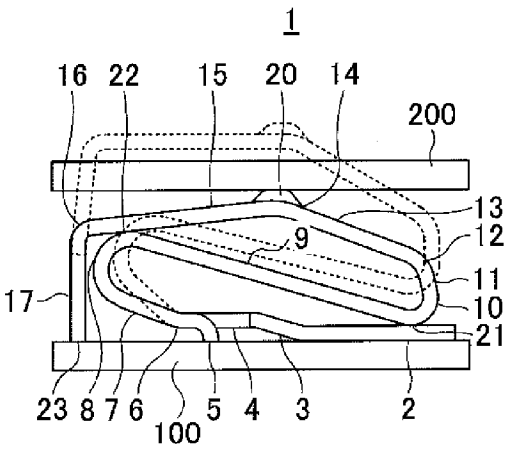
Figure 3D:
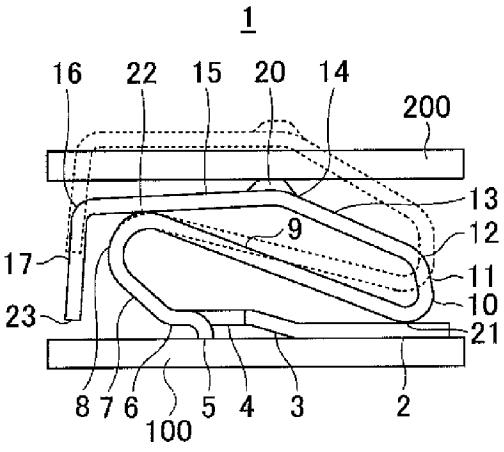

Next, referring to FIG. 3D, when the second board 200 is further depressed to come closer to the first board 100, the second bent portion bends on the first contact part 21 serving as a support, and the second contact part 22 comes into contact with the vicinity of the second bent part 8 of the first bent portion to restrict the bending of the second bent portion. This state is referred to as "second restricted state." In the transition from the first restricted state to the second restricted state, friction with the second bent portion occurs in the first contact part 21. Thus, a so-called wiping effect, which removes an oxide film on a surface with a frictional force, is produced, so that it is possible to improve the performance of a contact point.

In the transition from the first restricted state to the second restricted state, the horizontal part 15 rotates counterclockwise substantially about the first contact part 21 to be inclined. Therefore, a position of the electrically conductive part of the second board 200 at which the contacting part 20 comes into contact with the electrically conductive part gradually changes with the inclination of the contacting part 20. As a result, friction with the electrically conductive part of the second board 200 occurs in the contacting part 20. Thus, a so-called wiping effect, which removes an oxide film on a surface with a frictional force, is produced, so that it is possible to improve the performance of a contact point.

Next, referring to FIG. 3E, when the second board 200 is further depressed to come closer to the first board 100 after the bending of the first bent portion and the second bent portion is restricted, a bend in the shape of a chevron formed at the fifth bent part 14 between the fourth spring part 13 and the horizontal part 15 is pressed to widen, and at the same time, the first bent portion and the second bent portion are compressed so that the third contact part 23 comes into contact with the upper surface of the first board 100. A state where the third contact part 23 is in contact with the first board 100 is referred to as "third restricted state." In the third restricted state, a pressure on the contacting part 20 from the second substrate 200 is mostly received by the stopper part 17, so that the first bent portion and the second bent portion are less likely to receive more pressure. As a result, it is possible to prevent damage to or plastic deformation of the first bent portion and the second bent portion. The amount of stroke of the contact member 1 between the second restricted state and the third restricted state for prevention of damage to the first bent portion and the second bent portion may be suitably determined by the length of the stopper part 17, that is, the distance between the third contact part 23 and the first board 100. In the transition from the second restricted state to the third restricted state, friction with the first bent portion occurs in the second contact part 22. Thus, a so-called wiping effect, which removes an oxide film on a surface with a frictional force, is produced, so that it is possible to improve the performance of a contact point.

Figure 4:
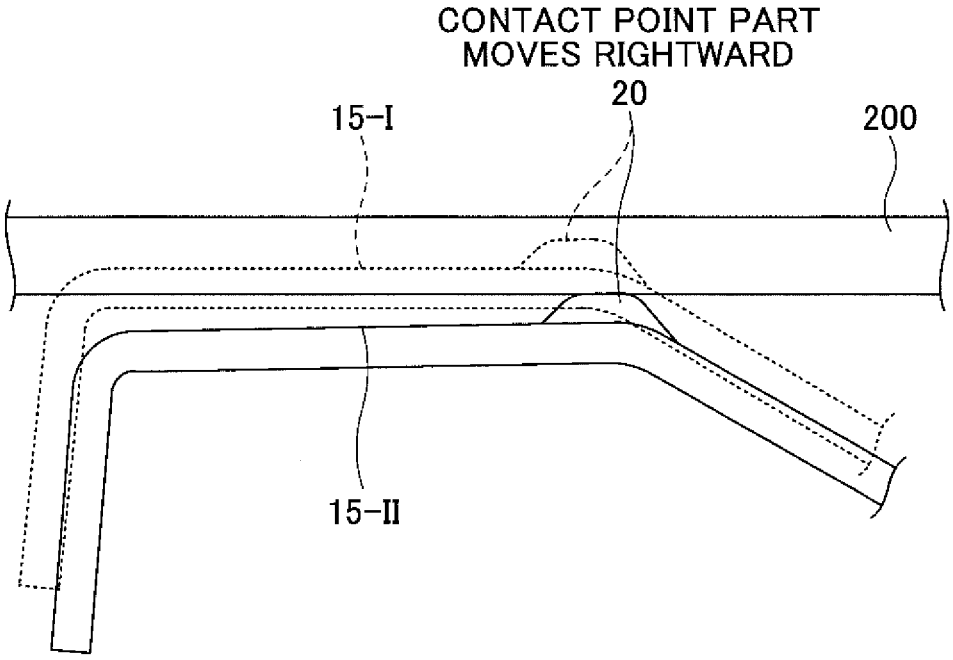
FIG. 4 is an enlarged view of a contact point part according to the embodiment.

FIG. 4 is an enlarged view of a contact point part where the contacting part 20 and the second board 200 are in contact. In FIG. 4, the initial position of the horizontal part 15 is denoted by 15-I. The horizontal part 15 is substantially horizontal (parallel to the upper surface of the first board 100) at the initial position 15-I, while at a position 15-II, where the second board 200 is most depressed, the horizontal part 15 is rotated counterclockwise relative to the initial position 15-I with the bending of the second bent portion, so as to be inclined toward the lower left in FIG. 4. Therefore, the contact point part where the contacting part 20 and the second board 200 are in contact moves rightward (in the direction of the fifth bent part 14 of FIGS. 3A through 3E) in accordance with the angle of inclination of the horizontal part 15.

Figure 5B:
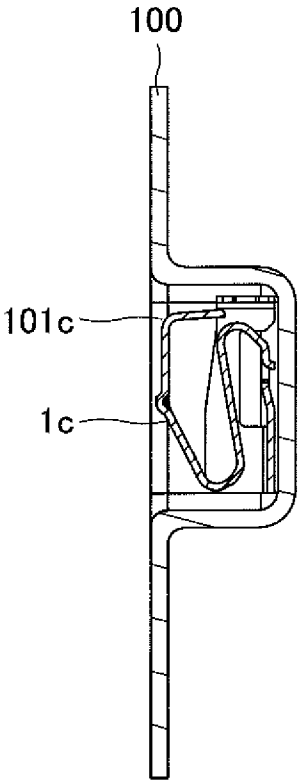
FIGS. 5A and 5B are diagrams illustrating the mounting of a contact member on a board according to the embodiment.
Figure 5A:
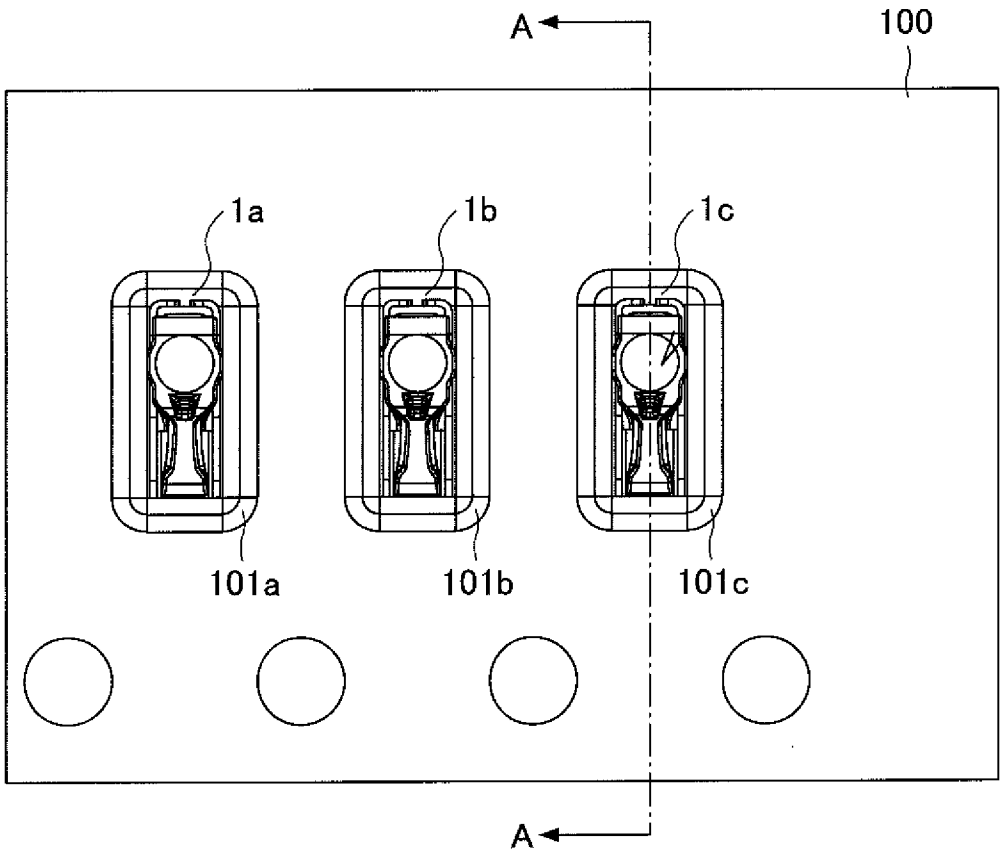

FIGS. 5A and 53 are diagrams illustrating the mounting of the contact member 1 on the first board 100. FIG. 5B is a cross-sectional view of FIG. 5A taken along a plane including line A-A. Referring to FIGS. 5A and 5B, three contact members 1, which are denoted by reference numerals 1*a*, 1*b*, and 1*c*, are enclosed in recesses 101*a*, 101*b*, and 101*c*, respectively, formed in the first board 100. This mounting method makes it possible to perform frame grounding also in mounting in the case of joining the first board 100 and the second board 200 (not illustrated in FIGS. 5A and 5B), placed on the opening side (left side in FIG. 5B) of the recesses 101*a* through 101*c*, with a gap (distance) smaller than the height of the contact member 1 in the third restricted state illustrated in FIG. 3E.

In the mounting illustrated in FIGS. 5A and 5B, the recesses 101*a* through 101*c* for enclosing the contact members 1*a* through 1*c*, respectively, are provided in the first board 100. Alternatively, for example, it is also possible to mount the contact members 1*a* through 1*c* on the first board 100 by attaching the contact members 1*a* through 1*c* to a housing package, which is provided separately from the first board 100, and attaching the housing package, to which the contact members 1*a* through 1*c* are attached, to the first board 100.

Next, a method of soldering a contact member is described with reference to FIG. 6.

Figure 6:
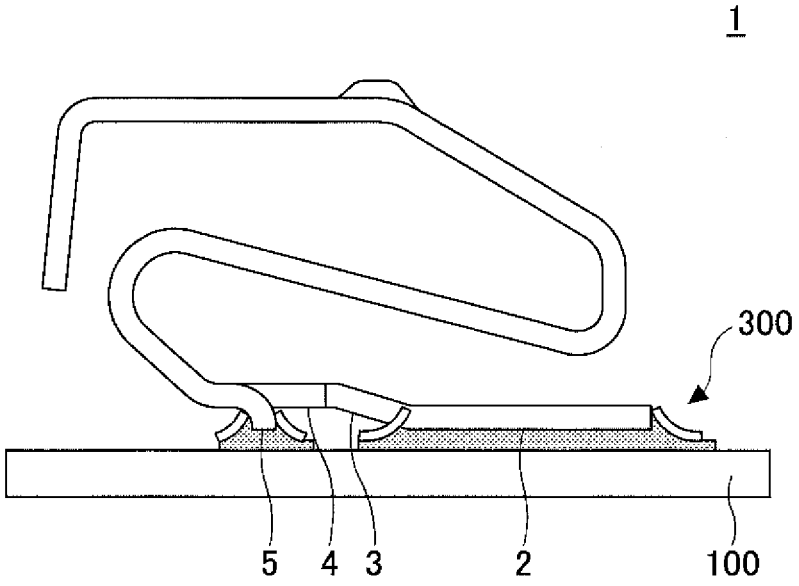
FIG. 6 is a diagram illustrating soldering of a contact member according to the embodiment.

FIG. 6 is a diagram illustrating soldering of a contact member. Referring to FIG. 6, the first joining part 2 and the second joining part 5 of the contact member 1 are placed on an electrically conductive part of the first board 100 on which solder paste 300 is printed by a suction nozzle of an automatic mounting apparatus (not illustrated). By heating the first board 100, the contact member 1 is soldered to the first board 100 at the first joining part 2 and the second joining part 5.

The contact member 1 includes the rising part 3, which is slanted at an angle from the first joining part 2 to rise from the upper surface of the first board 100, the intermediate part 4, which is spaced apart from the upper surface of the first board 100, and the second joining part 5 which extends from the opening part 4*a* of the intermediate part 4 to be joined to the upper surface of the first board 100. Therefore, an air gap is formed between the upper surface of the first board 100 and the intermediate part 4, and solder or flux provided in this air gap is prevented from moving up from the first board 100 to the contact member 1. Accordingly, it is possible to prevent problems such as so-called solder wicking or flux wicking, which causes solder or flux to adhere to a surface of the contact member 1 other than its surface facing the first board 100.

In FIG. 6, soldering is performed on the entire surface of the first joining part 2 that is joined to the first board 100. Alternatively, soldering may be performed in a spot manner on part of the surface of the first joining part 2.

Furthermore, in FIG. 6, the length of the second joining part 5 is so determined that the end of the second joining part 5 comes into contact with the upper surface of the first board 100 when the contact member 1 is soldered to the first board 100. Alternatively, the length of the second joining part 5 may be so determined that the end of the second joining part 5 does not come into contact with the upper surface of the first board 100 when the contact member 1 is soldered to the first board 100.

If the second joining part 5 is excessively long, the bottom surface of the first joining part 2 that is in contact with the first board 100 may come off the first board 100 because of the contact of the end of the second joining part 5 with the upper surface of the first board 100. Therefore, by determining the length of the second joining part 5 so that the end of the second joining part 5 does not come into contact with the upper surface of the first board 100 when the contact member 1 is soldered to the first board 100, it is possible to prevent the first joining part 2 from coming off the first board 100 even when the length of the second joining part 5 includes processing error, as long as the error does not cause the second joining part 5 to be excessively long.

Furthermore, in FIG. 6, the first joining part 2 and the second joining part 5 are soldered at a distance from each other. This reduces the area of contact with the first board 100 so that it is possible to reduce the amount of solder for soldering the contact member 1, compared with the case where the first joining part 2 extends to the first bent part 6 without the rising part 3, the intermediate part 4, and the second joining part 5, and the entire bottom surface of the extended first joining part 2 comes into contact with the upper surface of the first board 100, for example.

Furthermore, even in the case where the coefficient of thermal expansion differs between the first board 100 and the contact member 1, an extended portion of the second joining part 5 having an extending shape deforms to eliminate the difference in expansion due to heat, so that it is possible to eliminate the distortion of the contact member 1 at the time of soldering.

Figure 7:
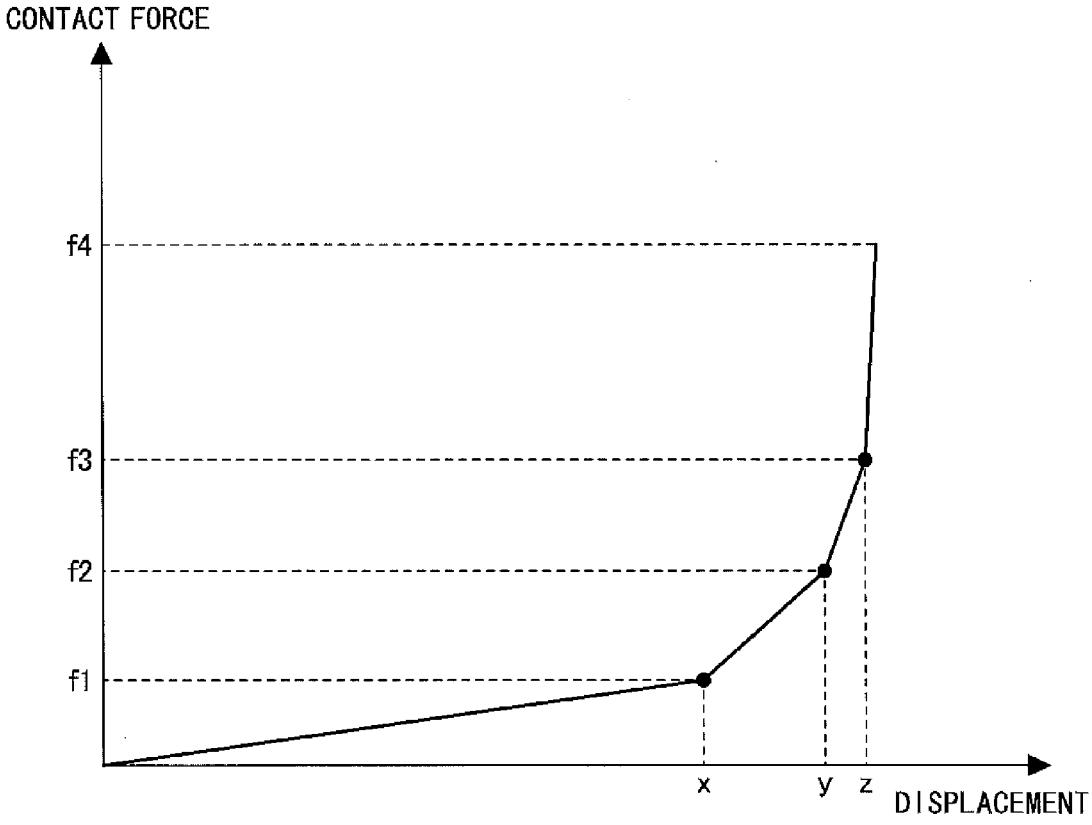
FIG. 7 is a graph illustrating a relationship between contact force and displacement of a contact member according to the embodiment.

FIG. 7 is a graph illustrating a relationship between contact force and displacement of the contact member 1. In FIG. 7, the displacement refers to a vertical displacement of the contact member 1 due to the pressing of the contacting part 20 by the second board 200, and the contact force refers to the force of contact of the contacting part 20 and the second board 200. FIG. 7 illustrates a case where the first spring constant is smaller than the second spring constant.

Referring to FIG. 7, when the contact member 1 is not pressed by the second board 200, the displacement is zero (0). When the contacting part 20 receives pressure from the second board 200, the first bent portion and the second bent portion start to bend, and at displacement "x", the first restricted state where the first contact part 21 is in contact with the lower surface of the second bent portion as illustrated in FIG. 3C is entered. The contact force at displacement "x" is indicated by "f1." In the case where the first spring constant is smaller than the second spring constant, basically, the first bent portion bends with the first spring constant from displacement "0" to displacement "x."

When the contacting part 20 is pressed by the second board 200 from the state of displacement "x," at displacement "y," the second restricted state where the second contact part 22 is in contact with the upper surface of the first bent portion as illustrated in FIG. 3D is entered. The contact force at displacement "y" is indicated by "f2."When the contact member 1 is displaced from displacement "x" to displacement "y," the bending of the first bent portion is restricted, and the second bent portion having the second spring constant larger than the first spring constant bends. Accordingly, the slope of the graph is steeper than from displacement "0" to displacement "x."

When the contacting part 20 is further pressed by the second board 200 from the state of displacement "y," at displacement "z," the third restricted state where the third contact part 23, which is the end point of the stopper part 17, is in contact with the first board 100 as illustrated in FIG. 3E is entered. The contact force at displacement "z" is indicated by "f3." From displacement "y" to displacement "z," the bending of the first bent portion and the bending of the second bent portion are restricted, so that the bend of the fifth bent part 14 widens and the bent part of the first bent portion and the bent part of the second bent portion are displaced in a compressed manner. Accordingly, the slope of the graph is steeper than from displacement "x" to displacement "y."

By the above transitions of restricted states, in the displacement range from "0" to "x," a large displacement (amount of stroke) may be obtained without much increase in the contact force. Furthermore, in the displacement range from "x" to "y," a large change in the contact force may be obtained with a small displacement. Furthermore, in the displacement range from "y" to "z," a large change in the contact force may be obtained with little change in the displacement. Furthermore, the bending of the first bent portion and the second bent portion is restricted at displacement "z," so that it is possible to prevent damage to the contact member 1. In FIG. 7, "f4" indicates the maximum value of the contact force that does not cause damage to the contact member 1. Because of the stopper part 17, the value of "f4" may be larger than the value of "f3", so that the contact member 1 may be protected from damage.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

For example, multiple joining parts that are shaped to extend toward a board surface like the second joining part 5 may be provided in contact members.

Furthermore, part of the first joining part 2 may be removed by piercing in order to reduce an area of placement of the first joining part 2 on a board.

What is claimed is:

1. A contact member that electrically connects a first board and a second board, comprising:

a joining part configured to be joined to the first board;

a contacting part configured to come into contact with the second board;

a first bent portion and a second bent portion provided between the joining part and the contacting part;

a first contact part configured to come into contact with the second bent portion when the first bent portion is caused to bend by pressing of the contacting part by the second board;

a second contact part configured to come into contact with the first bent portion when the second bent portion is caused to bend by the pressing of the contacting part by the second board after the first contact part comes into contact with the second bent portion; and a third contact part configured to come into contact with the first board by the pressing of the contacting part by the second board after the second contact part comes into contact with the first bent portion.

2. The contact member as claimed in claim 1, further comprising:

a horizontal part extending from the contacting part in a direction away from the second bent portion; and an attracted part provided on a first surface of the horizontal part.

3. The contact member as claimed in claim 2, wherein the second contact part is provided on a second surface of the horizontal part opposite to the first surface.

4. The contact member as claimed in claim 2, further comprising:

a stopper part bent from the horizontal part, wherein the third contact part is provided at an end of the stopper part.

5. The contact member as claimed in claim 4, further comprising:

a guide part bent from the joining part and configured to guide movements of the stopper part in a direction toward and a direction away from the first board.

6. The contact member as claimed in claim 2, wherein the contacting part is shaped to project from the horizontal part.

* * * * *